US010278496B2

(12) United States Patent
Serure

(10) Patent No.: US 10,278,496 B2
(45) Date of Patent: May 7, 2019

(54) THREE PARTS MODULAR FURNITURE SET

(71) Applicant: M&J SROUR PROPERTIES LLC, South Plainsfield, NJ (US)

(72) Inventor: Mark Serure, Brooklyn, NY (US)

(73) Assignee: M&J SROUR PROPERTIES LLC, South Plainfield, NJ (US)

( * ) Notice: Subject to any disclaimer, the term of this patent is extended or adjusted under 35 U.S.C. 154(b) by 0 days.

(21) Appl. No.: 15/729,235

(22) Filed: Oct. 10, 2017

(65) Prior Publication Data

US 2018/0027964 A1 Feb. 1, 2018

Related U.S. Application Data

(63) Continuation-in-part of application No. 14/972,665, filed on Dec. 17, 2015, now abandoned.

(51) Int. Cl.

| | |
|---|---|
| ***A47B 85/06*** | (2006.01) |
| ***A47D 11/00*** | (2006.01) |
| ***A47C 13/00*** | (2006.01) |
| ***A47D 7/01*** | (2006.01) |
| ***A47B 97/04*** | (2006.01) |
| ***A47D 9/00*** | (2006.01) |
| *A47B 85/02* | (2006.01) |

(52) U.S. Cl.

CPC ..... *A47B 85/06* (2013.01); *A47B 97/04* (2013.01); *A47C 13/005* (2013.01); *A47D 7/01* (2013.01); *A47D 9/00* (2013.01); *A47D 11/00* (2013.01); *A47D 11/005* (2013.01); *A47B 85/02* (2013.01)

(58) Field of Classification Search

CPC ..... A47B 85/06; A47B 83/00; A47B 83/02; A47C 13/00; A47C 13/005; A47C 17/04; A47C 17/16; A47C 17/34; A47D 11/002; A47D 11/005; A47D 11/007; B60N 2/34; B60N 2/348

USPC ..... 297/118, 119, 124, 125, 157.1, 158.1, 297/158.2, 158.3, 158.5, 146, 163, 232, 297/245; 108/12, 13

See application file for complete search history.

(56) References Cited

U.S. PATENT DOCUMENTS

| | | | | | |
|---|---|---|---|---|---|
| 101,118 | A * | 3/1870 | Gilles et al. | ..... | B64D 11/0638 297/146 |
| 170,678 | A * | 12/1875 | Mackenzie | ..... | A47B 85/04 297/121 |
| 321,825 | A * | 7/1885 | Koenig | ..... | A47C 17/2073 297/108 |
| 571,000 | A * | 11/1896 | Jackson | ..... | A47C 17/12 297/117 |

(Continued)

FOREIGN PATENT DOCUMENTS

| | | | | |
|---|---|---|---|---|
| CH | 159370 A | | 1/1933 | |
| CH | 159370 A | * | 1/1933 | ..... A47C 15/002 |

(Continued)

*Primary Examiner* — Robert Canfield

(74) *Attorney, Agent, or Firm* — Birch, Stewart, Kolasch & Birch, LLP

(57) ABSTRACT

A modular furniture set having three parts: two side parts configured as sitting furniture units; and at least one middle part, wherein all parts are configured such as to allow connecting each part to another part to build different furniture units and sets thereby, where the furniture units and sets comprise at least a bed with at least two different sizes and two sitting units which are formed by the two side parts.

6 Claims, 11 Drawing Sheets

(56) References Cited

U.S. PATENT DOCUMENTS 797,826 A * 8/1905 Sherman ..... A47B 83/045 297/135
988,513 A * 4/1911 Shea ..... B60N 2/34 297/233
995,234 A * 6/1911 Emerson ..... B61D 31/00 297/112
1,016,841 A * 2/1912 Fischer ..... B64D 11/0638 297/146
1,402,542 A * 1/1922 Scanlan ..... A47C 17/2073 297/108
1,618,737 A * 2/1927 Turner ..... A47B 83/045 297/135
1,757,960 A * 5/1930 Greenstreet ..... B60N 2/34 297/233
1,787,245 A * 12/1930 Graham ..... A47C 13/00 108/11
1,825,055 A 9/1931 De Bretteville
1,879,673 A * 9/1932 Fischer ..... A47C 7/52 297/248
1,928,508 A * 9/1933 Spang ..... A47B 85/04 297/125
1,952,949 A * 3/1934 Spang ..... A47C 17/22 297/118
2,087,574 A 7/1937 Kaufer
2,348,407 A * 5/1944 O'Neill ..... B61D 31/00 297/342
2,619,395 A * 11/1952 Kent ..... B60N 3/004 108/38
2,637,367 A * 5/1953 Barecki ..... A47B 5/04 297/146
2,642,119 A * 6/1953 Dary ..... A47C 11/00 297/121
2,897,876 A * 8/1959 Austin ..... A47B 85/06 297/125
2,963,078 A * 12/1960 Ferrelle ..... B60N 3/004 108/38
3,233,942 A * 2/1966 Helmut ..... A47B 85/00 297/118
3,241,885 A * 3/1966 Deaton ..... A47B 47/047 108/186
3,439,951 A * 4/1969 Wright ..... A47C 17/34 297/118
3,773,329 A 11/1973 Secter
3,811,728 A 5/1974 Redemske
3,817,573 A * 6/1974 Facury ..... A47B 85/04 108/62
3,944,281 A 3/1976 Piretti
4,050,736 A * 9/1977 Karp ..... A47B 83/02 297/135
4,060,277 A 11/1977 Leib
4,077,666 A 3/1978 Heumann
4,277,856 A 7/1981 Danin
4,311,337 A * 1/1982 Brunn ..... A47C 13/005 297/135
4,506,927 A * 3/1985 Lombardo ..... A47C 13/00 297/118
4,591,289 A 5/1986 Vickers et al.
4,657,302 A * 4/1987 Snyder ..... A47C 1/124 108/64
5,160,183 A * 11/1992 Rusyniak ..... A47C 7/506 297/119
D350,857 S * 9/1994 Warren ..... D6/336
5,720,515 A * 2/1998 Haffner ..... B60N 2/879 297/188.04
5,876,092 A * 3/1999 An ..... B60N 3/004 297/146
6,296,314 B1 * 10/2001 Klein ..... A47B 85/04 297/119
6,705,235 B1 * 3/2004 Gerutto ..... A47B 5/00 108/152
6,824,220 B1 * 11/2004 Davison ..... A47C 13/005 297/233
6,848,129 B1 * 2/2005 Amato ..... A47D 7/02 5/97
7,020,911 B2 * 4/2006 Oldham ..... A47C 13/005 297/411.24
7,651,160 B2 * 1/2010 Okumura ..... B60N 3/004 108/42
8,267,017 B1 * 9/2012 Michael ..... A47B 5/04 108/134
8,528,972 B2 * 9/2013 Johnsson ..... A47C 4/02 297/233
8,783,778 B2 7/2014 Nelson et al.
8,857,347 B1 * 10/2014 Liu ..... A47B 5/02 108/47
9,004,585 B1 4/2015 Pidgornyy
9,179,769 B1 * 11/2015 Port ..... A47C 1/12
9,242,733 B2 * 1/2016 Pajic ..... B64D 11/00152
9,277,813 B2 * 3/2016 Nelson ..... A47B 87/00
9,357,839 B1 * 6/2016 Liu ..... A47B 5/02
9,380,863 B2 * 7/2016 Sakanoue ..... B60N 3/002
9,414,670 B2 * 8/2016 Bo ..... A47B 3/002
9,488,204 B2 11/2016 King
2004/0124327 A1 * 7/2004 Cheng ..... A47B 5/006 248/244
2007/0085406 A1 4/2007 White, III et al.
2011/0233976 A1 9/2011 Hanson et al.
2013/0255044 A1 * 10/2013 Chen ..... A47C 1/124 24/572.1
2015/0015034 A1 1/2015 Whittington et al.
2015/0336672 A1 * 11/2015 Hommel ..... B64D 11/0015 297/163
2016/0174715 A1 6/2016 Nelson et al.

FOREIGN PATENT DOCUMENTS

DE 1779030 U * 12/1958
DE 1779030 A1 * 8/1971 ..... A47B 83/02
DE 2 042 117 A 2/1972
DE 2042117 A1 * 2/1972 ..... A47C 17/34
DE 2 237 972 A 2/1974
DE 2237972 A1 * 2/1974 ..... A47C 17/34
DE 4213596 A1 * 10/1993 ..... A47D 7/01
DE 100 11 073 A1 10/2001
FR 674903 A * 2/1930 ..... A47D 7/01
FR 1204180 A * 1/1960 ..... A47D 7/01
FR 1 262 080 A 5/1961
FR 1262080 A * 5/1961 ..... A47D 11/005
FR 1 503 912 A 12/1967
FR 1503912 A * 12/1967 ..... A47B 87/00
FR 1 533 405 A 7/1968
FR 2 049 474 A 3/1971
FR 2049474 A5 * 3/1971 ..... A47D 7/01
GB 809000 A 2/1959
GB 809000 A * 2/1959 ..... A47C 17/34
GB 1119452 A 7/1968
JP 2-61256 A 3/1990
JP 11309050 A * 11/1999 ..... A47D 11/005
WO WO 2005041718 A1 * 5/2005 ..... A47B 85/06

* cited by examiner

THREE PARTS MODULAR FURNITURE SET

CROSS-REFERENCE TO RELATED PATENT APPLICATIONS

This application is a continuation in part (CIP) of U.S. patent application Ser. No. 14/972,665, which is incorporated herein by reference in its entirety

FIELD OF THE INVENTION

The present invention generally relates to the field of furniture and more particularly for modular furniture for forming a plurality of furniture units therefrom.

BACKGROUND OF THE INVENTION

Baby, children and toddler beds are used for a limited period of time until the bed does not fit the size of the baby, toddler or child and therefore this bed furniture is usually either thrown, sold or given away after a few years.

To make use of baby furniture after the child outgrows it some manufacturers provide modular cots that enable turning the cot into a child's bed or a toy such as described in DE10011073.

SUMMARY OF THE INVENTION

The present invention provides a modular furniture set having three parts: two side parts configured as sitting furniture units; and at least one middle part, wherein all parts are configured such as to allow connecting each part to another part to build different furniture units and sets thereby, where the furniture units and sets comprise at least a bed with at least two different sizes and two sitting units which are formed by the two side parts.

According to some embodiments, each of the parts comprises a base structure framed such as to connect to another part of the modular furniture set through connecting means. The side parts may also comprise back and/or side support structures.

Optionally, the connecting means comprise protruding pins configured for being inserted through recesses perforated over a frontal edge of the frames of the side and middle parts for interlocking said parts to one another.

Alternatively, the connecting means comprise screws and connecting plates.

According to some embodiments, the furniture set further comprises at least one mattress or pillow configured for fitting onto at least one of the furniture set parts.

According to some embodiments, the middle part comprises support legs for forming a table or stool when separated from the side parts.

Optionally, each of the side parts comprises support legs. The present invention provides a modular furniture set having multiple parts:

- two side parts configured as one type of furniture design; and
- at least one middle part,
- at least one board;
- wherein all parts are configured such as to allow connecting each part to another part to build different type of furniture designs,
- wherein at different furniture design unit, the at least one board is configured to be attached to a different part, providing different functionality at each design.

According to some embodiments of the present invention each of said parts comprises a base structure framed such as to connect to another part of the modular furniture set through connecting means.

According to some embodiments of the present invention the side part are deigned as sitting platform According to some embodiments of the present invention said side parts also comprise back and/or side support structures.

According to some embodiments of the present invention the board is connected to at least one side part functioning as a top table.

According to some embodiments of the present invention the board is connected at the back side of side part.

According to some embodiments of the present invention the board is connected at the front side of side part.

According to some embodiments of the present invention the board is connected to at least one side part functioning as a seat.

According to some embodiments of the present invention the board is connected on the top of middle part functioning as table.

According to some embodiments of the present invention the at least board is connected at an angle, to the middle part, functioning as an easel.

According to some embodiments of the present invention middle part comprises support legs for forming a table or stool when separated from said side parts.

According to some embodiments of the present invention each of said side parts comprises support legs.

BRIEF DESCRIPTION OF THE DRAWINGS

FIG. 1A shows the modular furniture assembled as a child's or a toddler's bed with all three parts connected to one another; FIG. 1B shows the first sitting set comprising an elongated rest sofa and a shorter sofa; and FIG. 1C shows the second sitting set including two sofas and a table.

FIG. 2A shows the modular furniture disassembled (exploded view); FIG. 2B shows the set assembled as a toddler bed.); FIG. 2C shows the modular furniture disassembled (exploded view) with top seating according to some embodiments of the present invention.

DETAILED DESCRIPTION OF SOME EMBODIMENTS OF THE INVENTION

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention provides a modular furniture set having at least three parts: at least one middle part and two side parts. The furniture is configured for building from its parts several beds and resting sets configurations including, for example, different sized toddler or child beds, and resting sets including sofas and optionally also a table.

The three or more parts can be used as a standalone furniture units such as table and sofas or assembled to form one or more other furniture units such as a toddler/child's bed or elongated resting sofa and the like.

The present invention provides a modular furniture set having multiple parts: two side parts configured as one type of furniture design; and at least one middle part, at least one board. All parts are configured such as to allow connecting each part to another part to build different type of furniture designs, At the different furniture design unit, the at least one board is configured to be attached to a different parts, providing different functionality at each design.

Figure 1A:
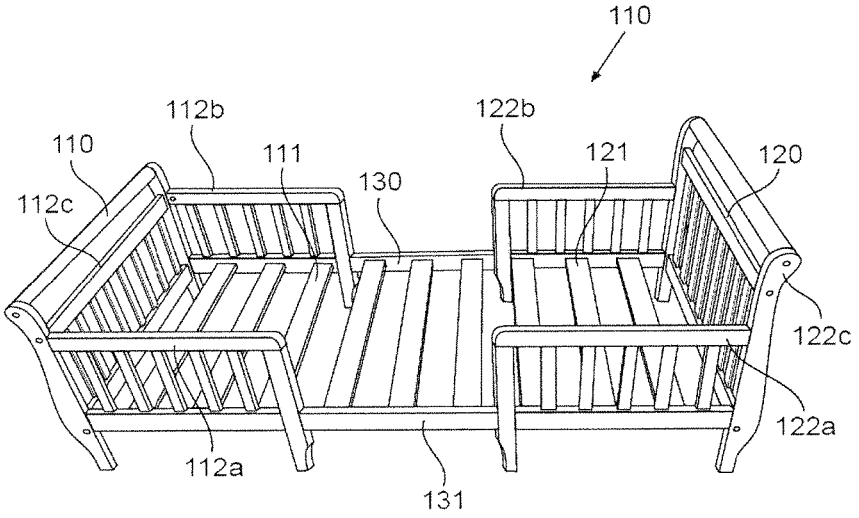
FIGS. 1A-1C show a modular furniture having three parts: two side parts and a middle part that can be modulated into several different furniture units or sets: a toddler's bed, a child's bed, a first sitting set comprising an elongated rest sofa and a shorter sofa, and a sitting set including a table or stool such as footstool and two sofas, according to some embodiments of the present invention.
Figure 1B:
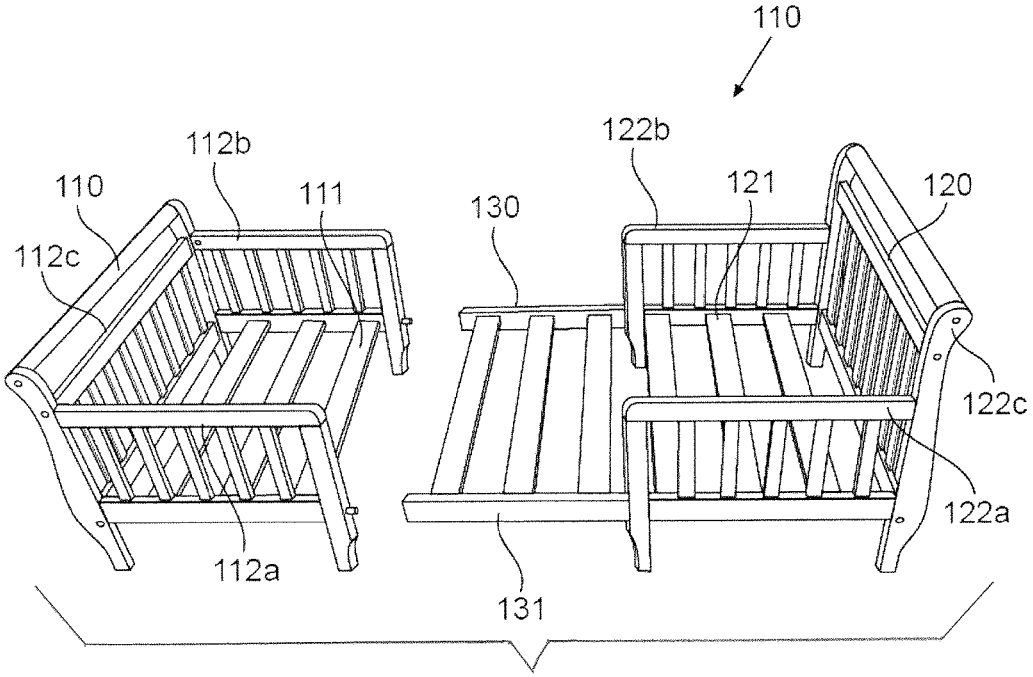
Figure 1C:
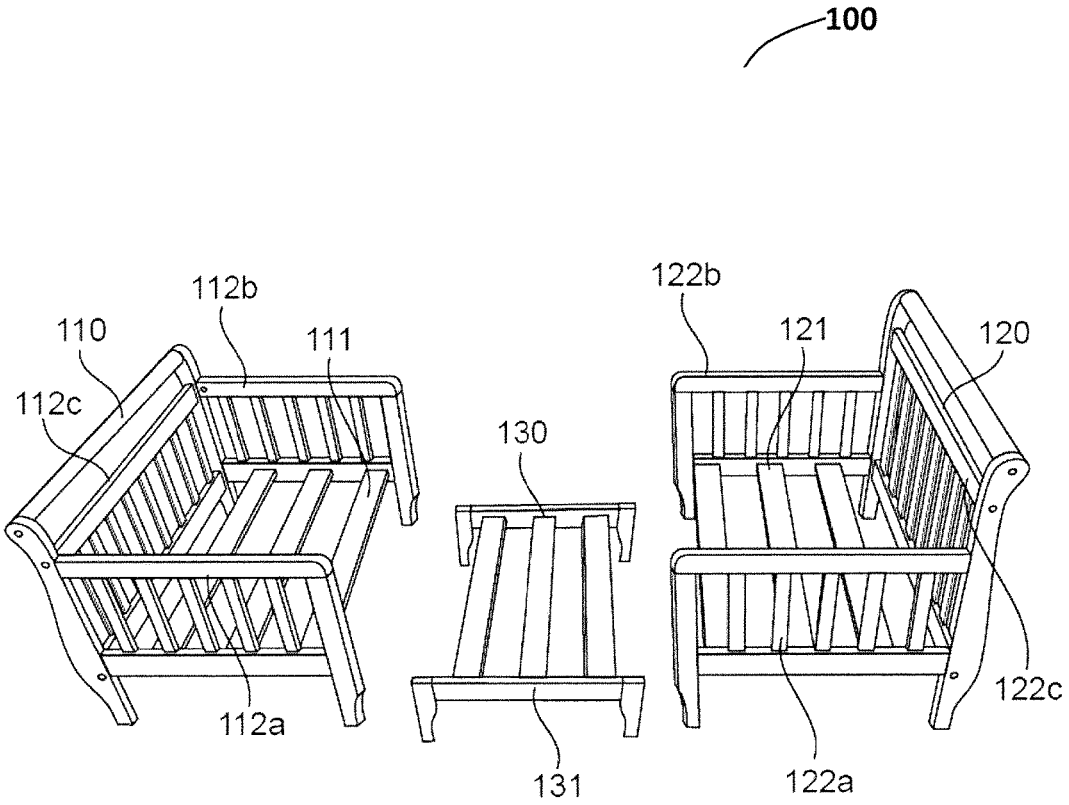

Reference is now made to FIGS. 1A-1C showing a modular furniture set 100 having three parts: two side parts 110 and 120 and a middle part 130 that can be modulated into several different furniture units or sets: a toddler's bed, a child's bed, a first sitting set comprising an elongated rest sofa and a shorter sofa, and a sitting set including a table and two sofas, according to some embodiments of the present invention.

FIG. 1A shows the modular furniture set 100 assembled as a child's or a toddler's bed with all three parts 110-130 connected to one another such that the two sides parts 110 and 120 connect to each side of the middle part 130 to form the bed design. Each part includes a base structure such as bases 111, 121 and 131 in this case constructed from multiple support boards. In other cases the bases may be constructed of a single platform board. Each of the side parts 110 and 120 includes one or more safety and/or support structures such as side supports 112*a*-112*b* and 122*a*-122*b* and back supports 112*c* and 122*c*.

Optionally, the middle part 130 also includes side supports for preventing falling of the child.

For younger or shorted children or toddlers the bed may be modulated such as not to include the middle part 130 by simply connecting the side parts 110 and 120 to one another (not shown).

FIG. 1B shows the first sitting set modulation of the modular furniture set 100 comprising an elongated rest sofa constructed by connecting one of the side parts 120 to the middle part 130; and a shorter sofa formed by the other side part 110 when disconnected.

FIG. 1C shows the second sitting set optional modulation of the modular furniture set 100 including two sofas formed by the disconnected two side parts 110 and 120 and a table, which is formed from the middle part 130.

Of course to use the furniture set 100 in any way for resting (whether sitting or lying) mattresses should be placed over the support bases of the sofas or bed fitting the furniture size in the respective modulated state thereof. For using the middle part 130 as a table placement of a table platform over the base 131 may be required unless the base 131 is formed from a platform board.

Any type and mechanism of removable connections can be used for connecting the parts 110-130 to one another such as by using interlocking niches and protrusions, bolts, screws and the like.

For example (not shown) the edges of the parts 110-130 that are supposed to connect or engage one another to form all the optional configurations and sets, may include recesses of the same size, depth etc., wherein to connect one part to another pin members can be inserted to the recesses of one of the parts to interlock into the recesses of the other part to which it should be connected.

In other embodiments connecting plates can be used with screws to connect the parts to one another.

In yet another embodiment, the parts can be simply placed adjacent to one another.

Figure 2A:
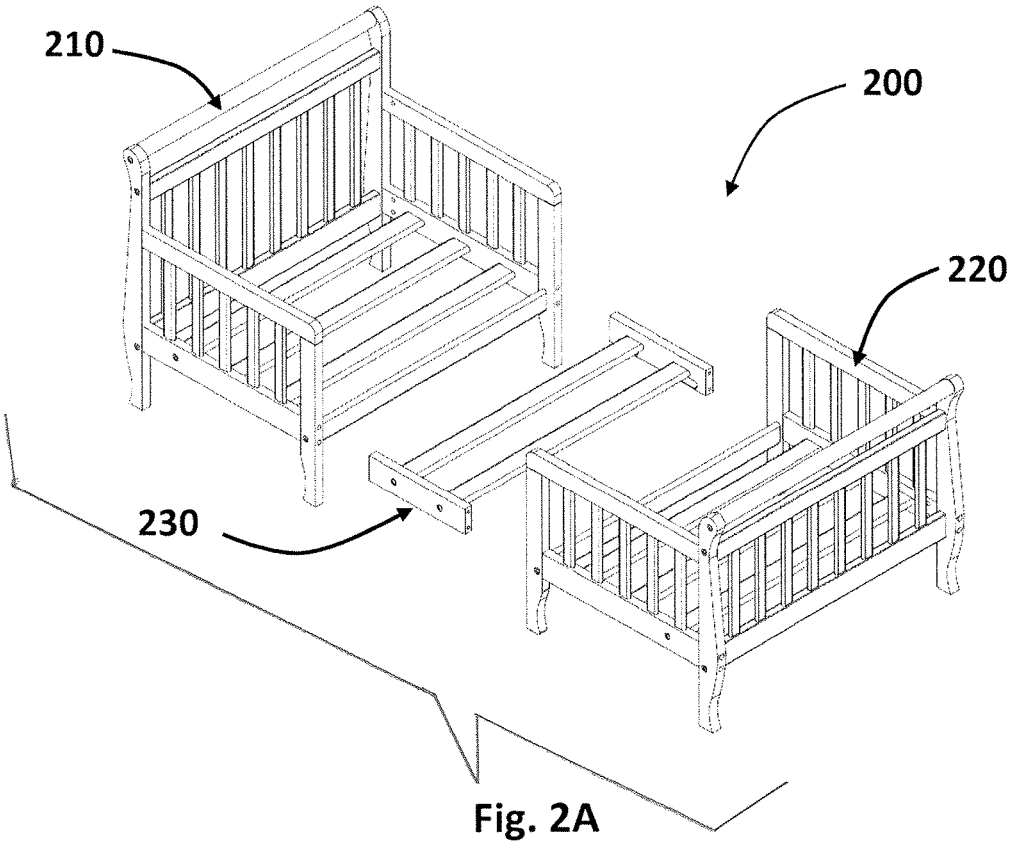
FIGS. 2A-2C show another modular furniture having three parts: two side parts and a middle part that can be modulated into several different furniture units or sets: a toddler's bed, a child's bed, an elongated rest sofa and a sitting set including two sofas, according to some embodiments of the present invention.
Figure 2B:
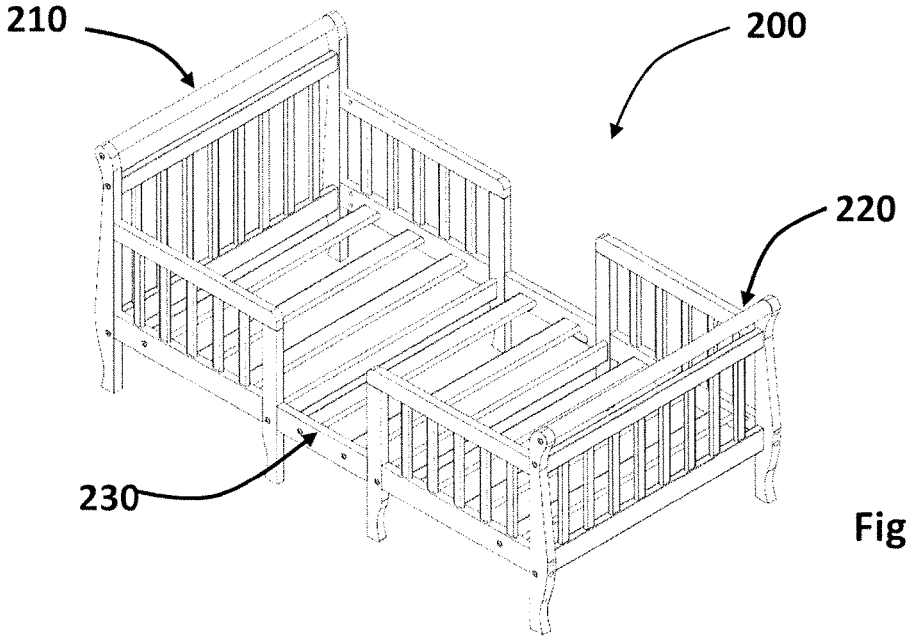

FIGS. 2A-2B show another modular furniture 200 having three parts: two side parts 210 and 220 and a middle part 230 that can be modulated into several different furniture units or sets: a toddler's bed such as shown in FIG. 2B, a child's bed (when the two side parts 210 and 220 are connected without the middle part 230), an elongated rest sofa (when one of the side parts 210/220 connects to the middle part 230) with another sofa which is the other side part 220/210 and a sitting set including two sofas which are the two side parts 210 and 220 when disconnected to one another and to the middle part 230, according to other embodiments of the present invention It is shown in FIG. 2A that the middle part 230 in this configuration does not have legs for supporting thereof and therefor to use it as a table legs or other support means must be attached thereto.

In some embodiments several middle parts are provided for extending the length of the bed to the desired size as the child grows and for using thereof as several tables or for modularly adjusting the size/length of the table by adding middle part units to one another and connecting support members such as legs at bottom edges thereof.

In some embodiments one or more mattresses and/or pillows are also provided as parts of the furniture set.

Figure 2C:
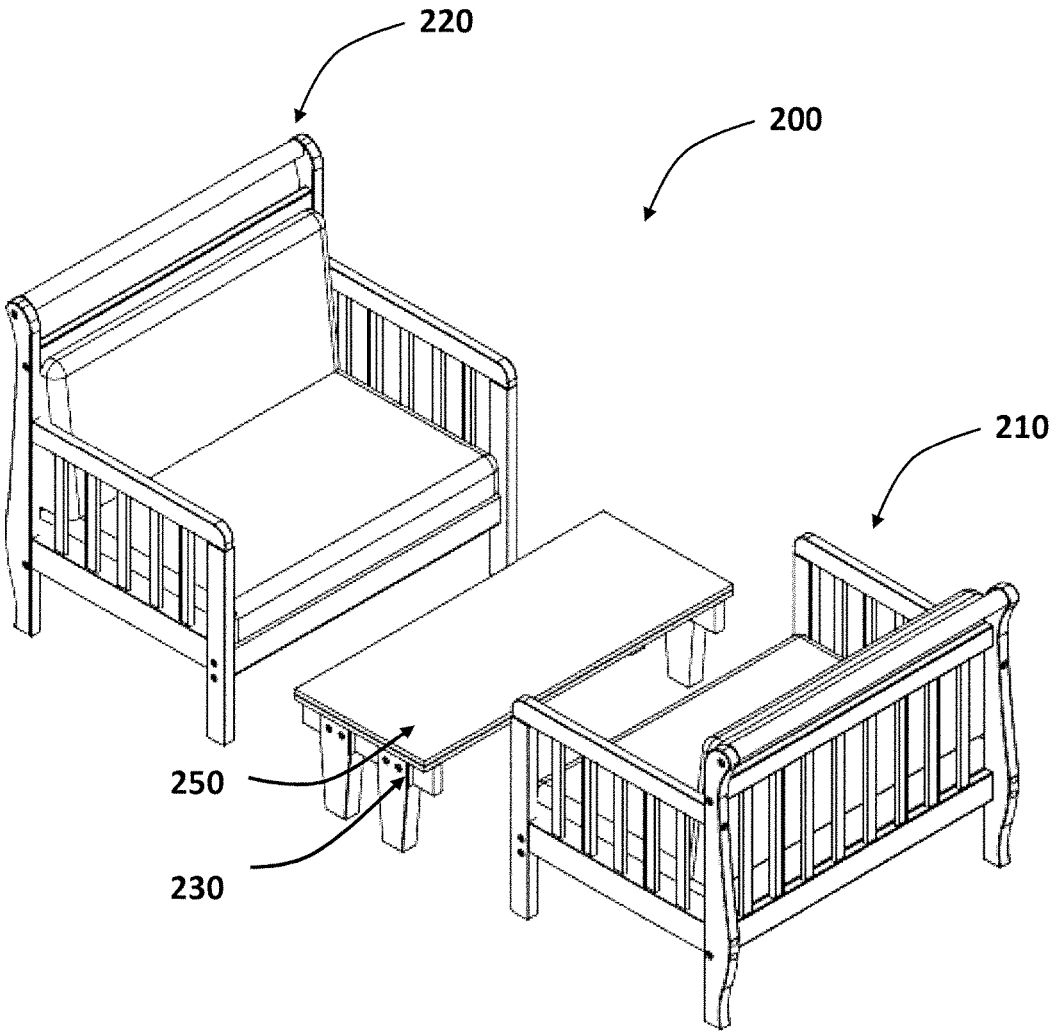

FIG. 2C shows the modular furniture disassembled (exploded view) with top table according to some embodiments of the present invention. According to this setting are provided to sitting furniture (210 and 220) with a table furniture (230) having top table board 250.

Figure 3:
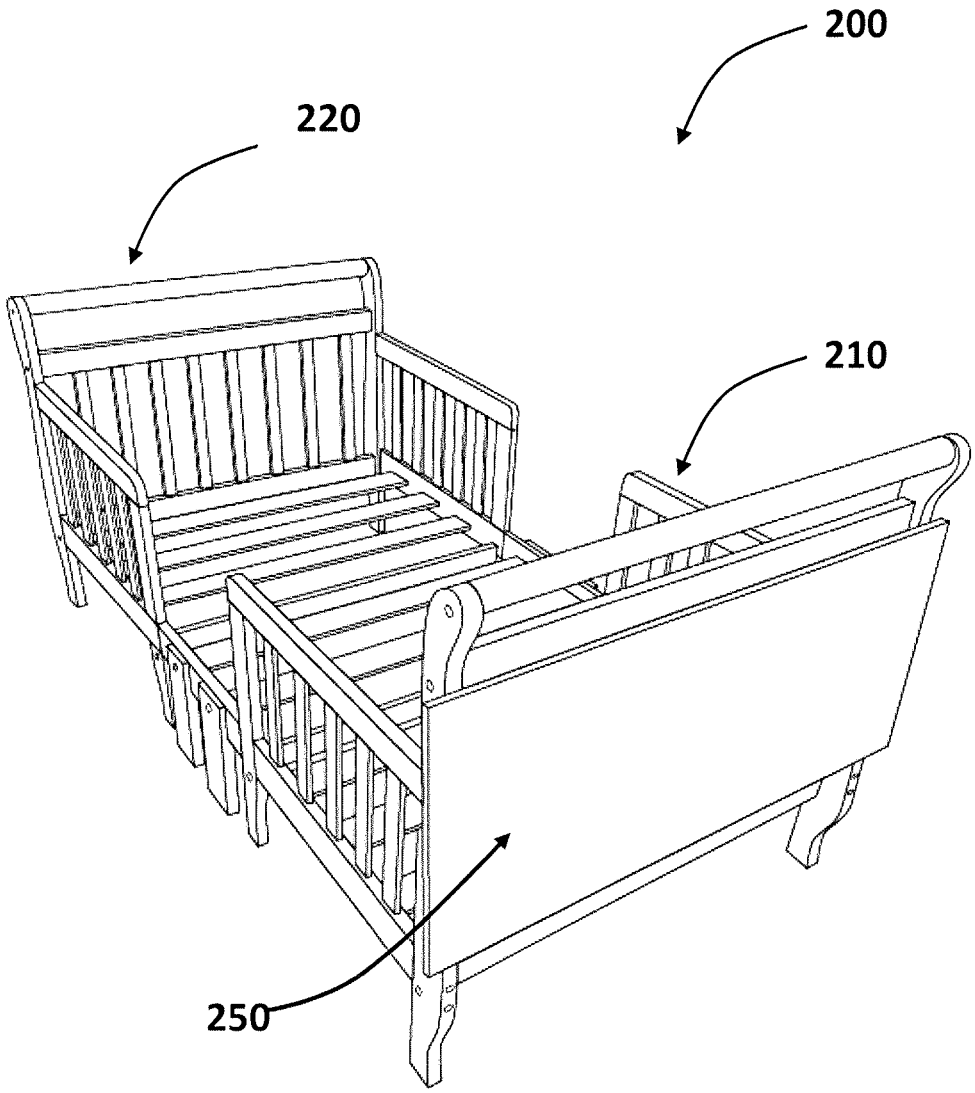
FIG. 3 shows the set assembled as a toddler bed having an extension of table top at close position according to some embodiments of the present invention.
Figure 3A:
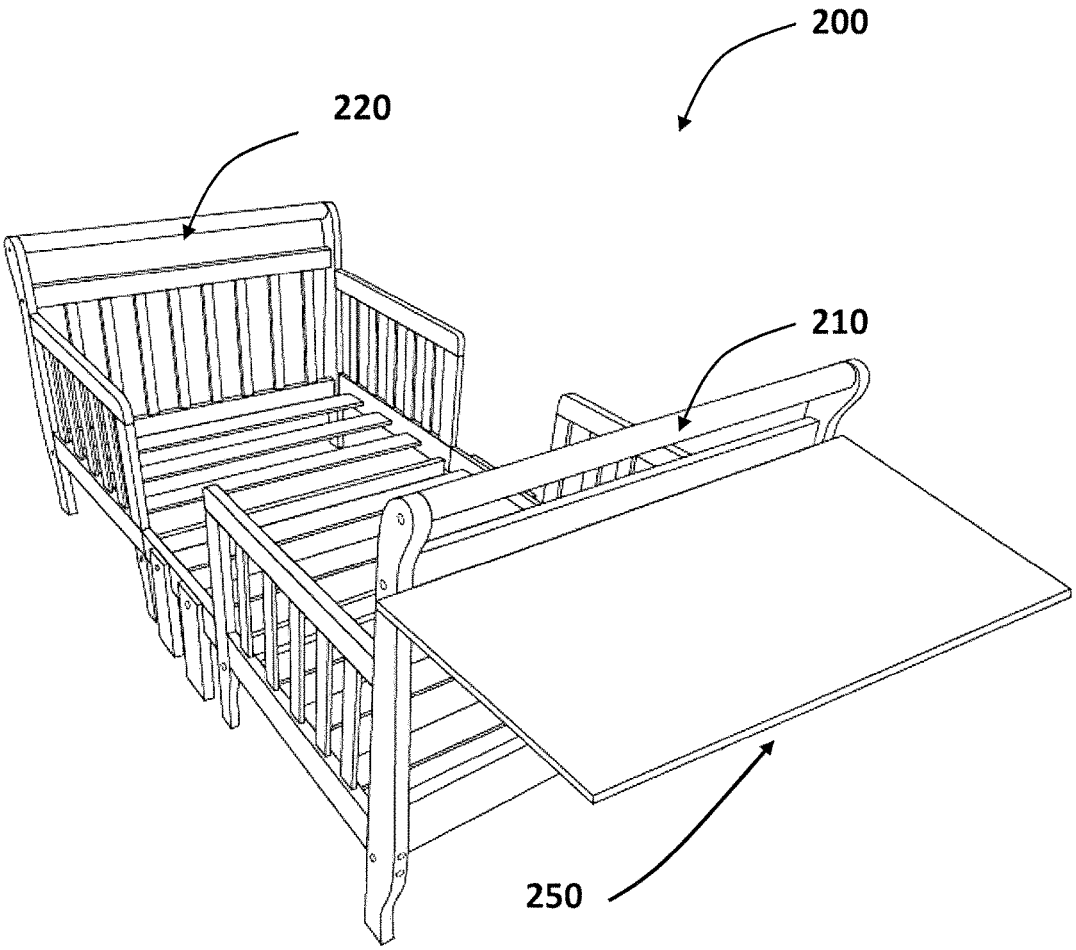
FIG. 3A shows the set assembled as a toddler bed having an extension of table top at open position, according to some embodiments of the present invention.

FIG. 3 shows the set assembled as a toddler bed having an extension of table top at close position according to some embodiments of the present invention; according this setting is provided an assembled furniture as a toddler bed comprised of the side parts 210 and 220 and the middle part 230. At the back of side part 210 is connected board 250 with a hinge, enabling to rotate from an open position (seen in this figure) to a close position (as seen in FIG. 3A). At the open position the board can serve as a shelf or top table.

Figure 4:
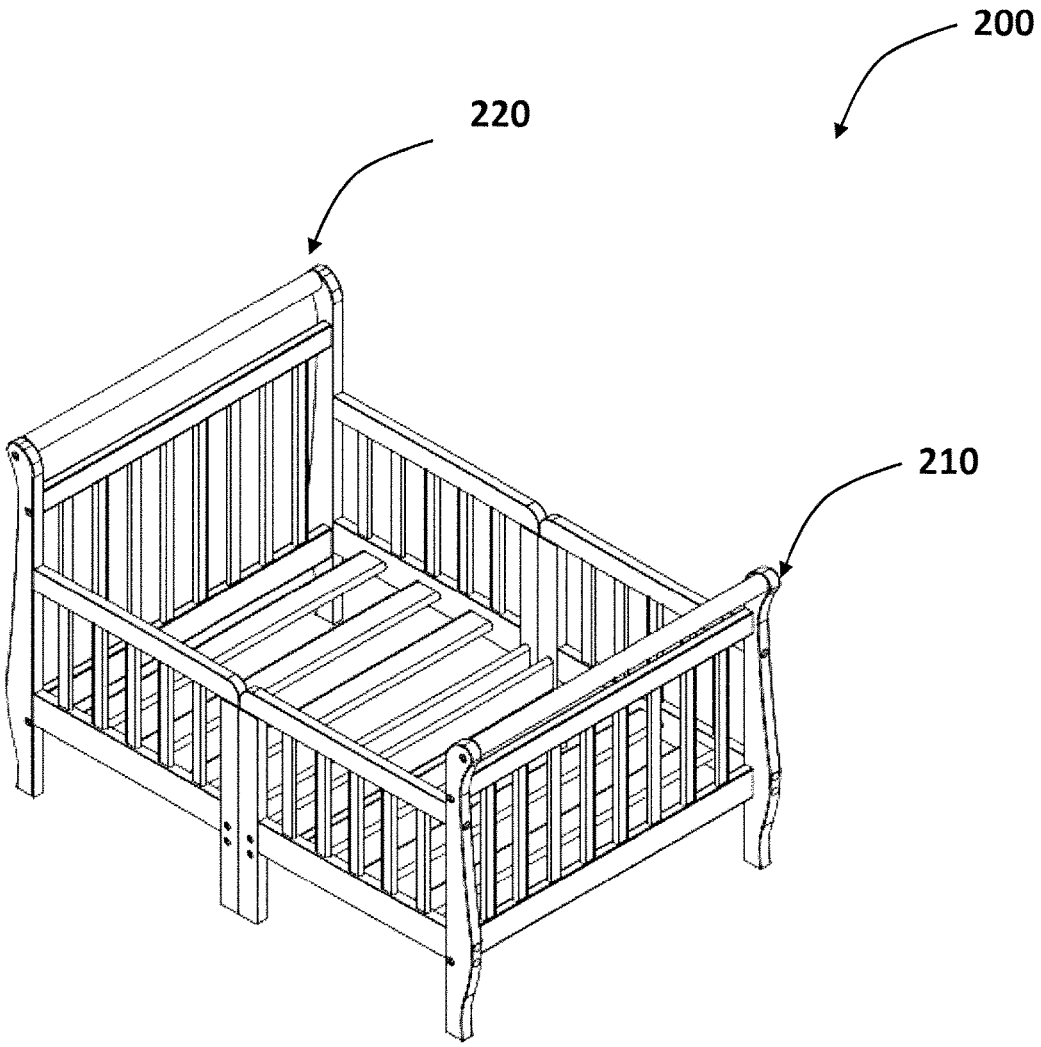
FIG. 4 shows the set assembled as a toddler bed in smaller size without the middle par, according to some embodiments of the present invention.

FIG. 3A shows the set assembled as a toddler bed having an extension of table top at open position, according to some embodiments of the present invention;

FIG. 4 shows the set assembled as a toddler bed in smaller size without the middle par, according to some embodiments of the present invention. According to this setting the toddler bed is comprised only by the side parts providing bed for smaller kids.

Figure 5A:
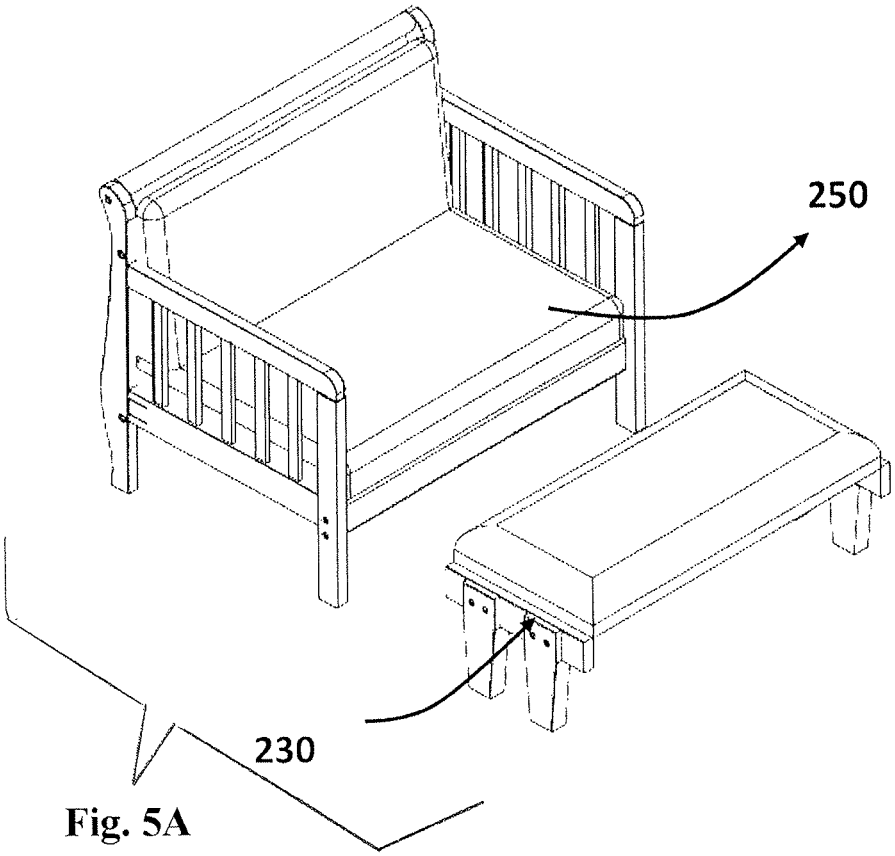
FIG. 5A shows the set assembled as a chair with a foot-rest, according to some embodiments of the present invention.
Figure 5B:
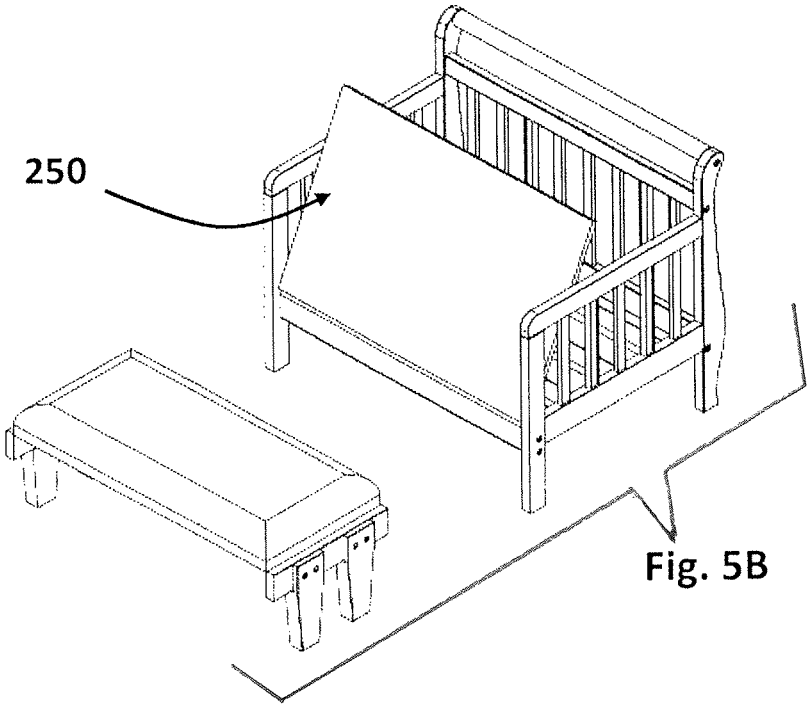
FIG. 5B shows the set assembled as a chair with a foot-rest, where the chair seat cover rotates, according to some embodiments of the present invention.

FIG. 5A shows the set assembled as a chair with a foot-rest, according to some embodiments of the present invention; According to this setting is provide a chair having top sitting part 250, which can be rotated as seen in FIG. 5B to extend the sitting area. Optionally the board can be detached and reconnected at the top of the chair arms serving as a top table as seen in FIG. 5*c*.

Figure 5C:
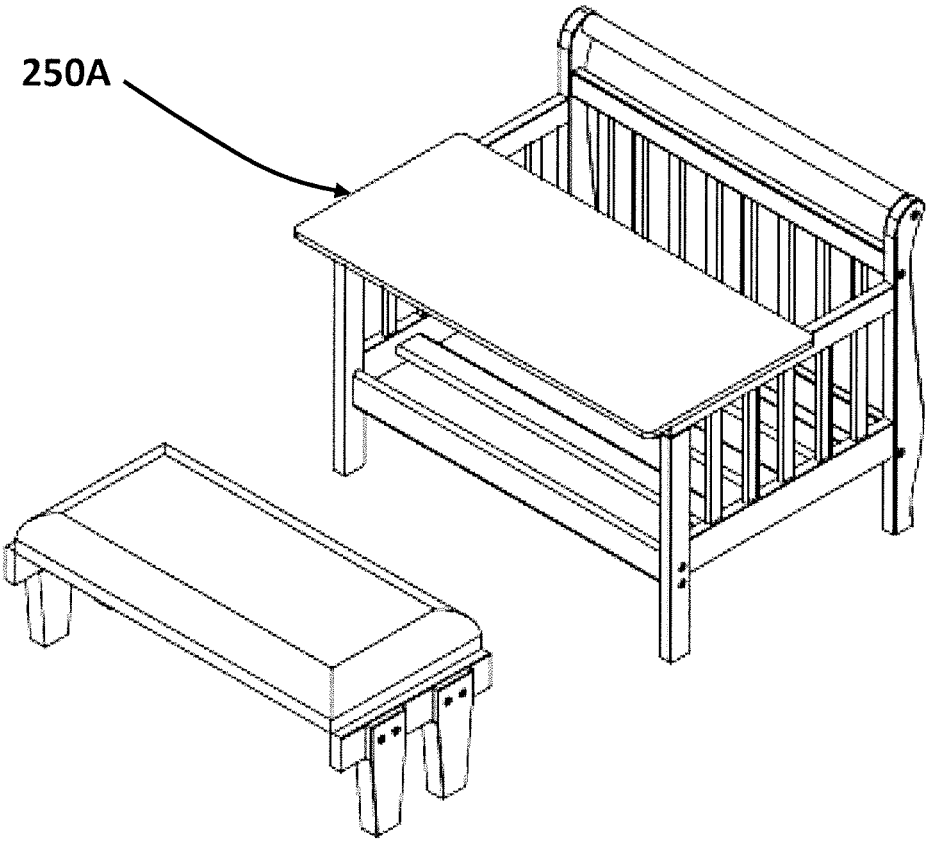
FIG. 5C shows the set assembled as a chair having table like setting with a foot-rest, according to some embodiments of the present invention according to some embodiments of the present invention.
Figure 6:
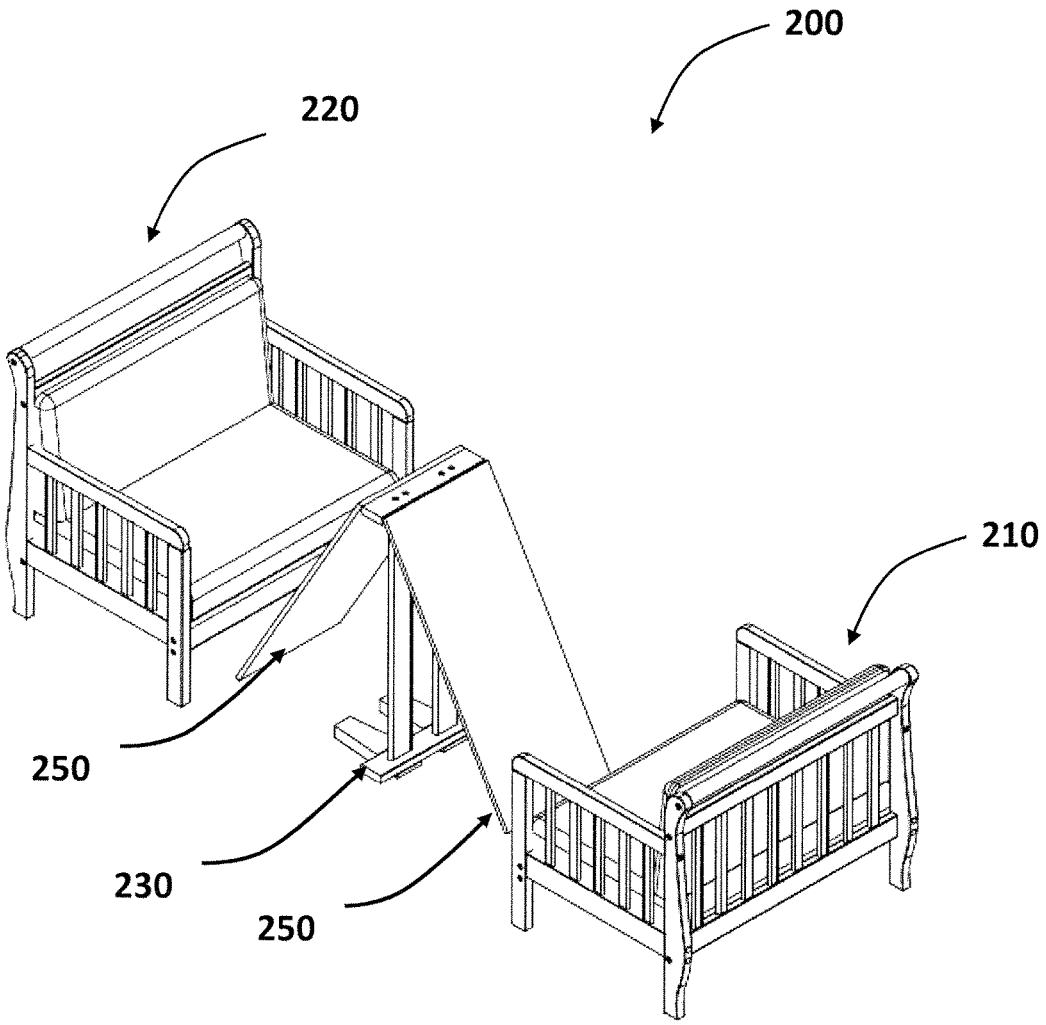
FIG. 6 shows the set assembled as set of two chairs with an easel according to some embodiments of the present invention.

FIG. 5B shows the set assembled as a chair with a foot-rest, where the chair seat cover rotates, according to some embodiments of the present invention;

FIG. 5C shows the set assembled as a chair having table like setting with a foot-rest, according to some embodiments of the present invention according to some embodiments of the present invention;

FIG. 6 shows the set assembled as set of two chairs with an easel according to some embodiments of the present invention. According to this setting the middle part is positioned on its side and two boards 250 are connected on one end to the top of the middle part at an angle, touching at the other end on the floor.

Figure 7:
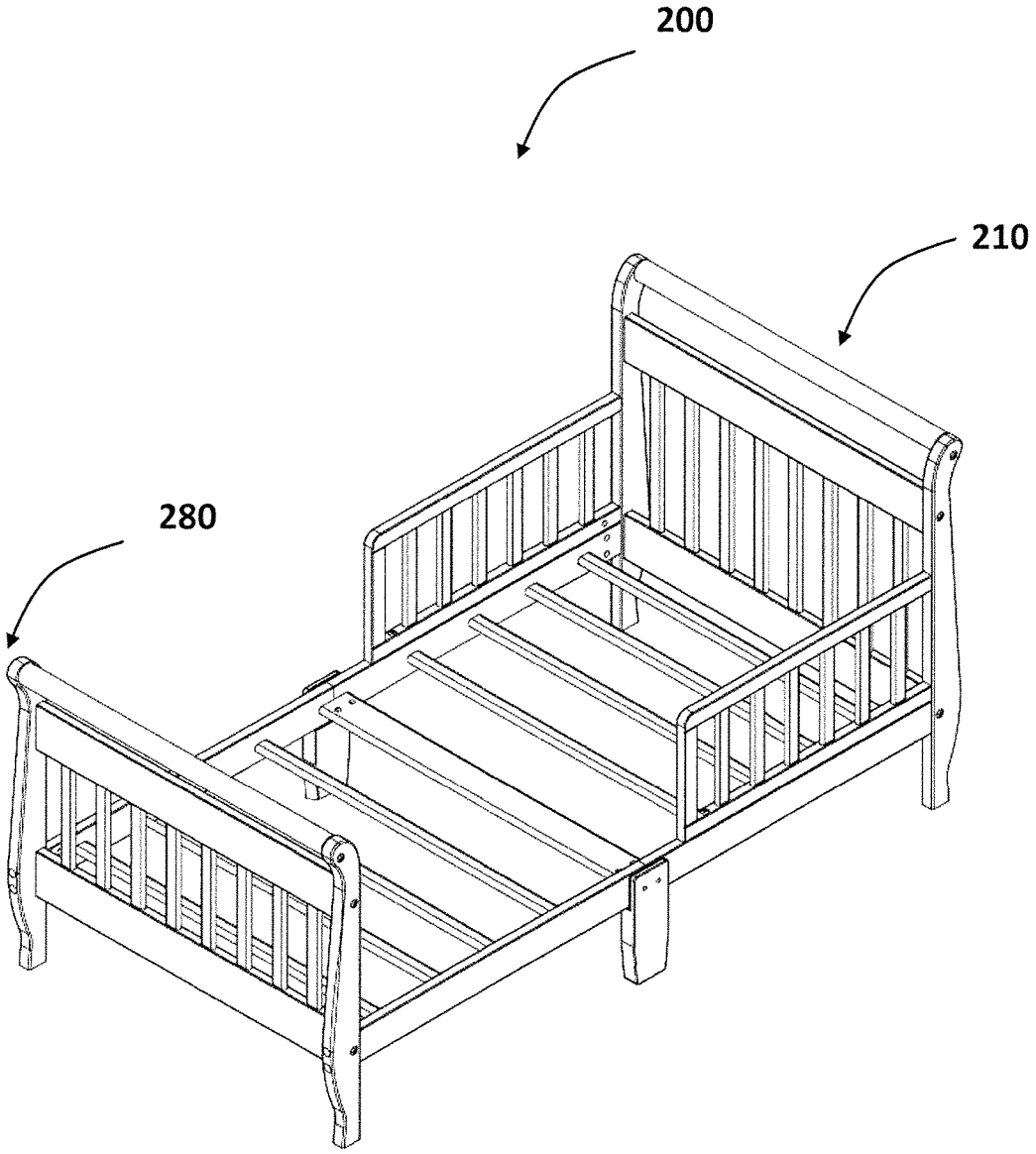
FIG. 7 shows assembled as a toddler bed with open sides according to some embodiments of the present invention.

FIG. 7 shows the set assembled as a toddler bed with open sides according to some embodiments of the present invention; According to this setting the toddler bed is comprised of the two side parts, where one side part has no arms.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments and/or by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Although the invention has been described in detail, nevertheless changes and modifications, which do not depart from the teachings of the present invention, will be evident to those skilled in the art. Such changes and modifications are deemed to come within the purview of the present invention and the appended claims.

The invention claimed is:

1. A modular furniture set having multiple parts:

two side parts configured as one type of furniture design;

at least one middle part forming a table having at least two horizontal top surfaces having space in between and at least two legs;

wherein each said side part includes a front side intended to interact with the middle part and a back side opposite to the front side wherein each side part forms a seat having at least one horizontal surface, at least two legs and backrest; and at least one board;

wherein the at least one board in one configuration is supported horizontally on the middle part covering the entirety of the at least two horizontal surfaces and the space between them, and wherein the modular furniture set is configured so that the at least one board may be connected in perpendicular to the top edge of the backrest of a said side part to serve as an extension table in another configuration.

2. The modular furniture set according to claim 1, wherein each of said parts comprises a base structure framed such as to connect to another part of the modular furniture set through connecting means.

3. The modular furniture set according to claim 2, wherein said side parts also comprise side support structures.

4. The modular furniture set according to claim 3, wherein the at least one board may be connected at the front side of a side part in a further configuration.

5. The modular furniture set according to claim 1, wherein each side part is useable as a sitting platform.

6. The modular furniture set according to claim 1, wherein the at least one board may be connected to one side part to function as a seat.

* * * * *